US006198886B1

(12) United States Patent
Brewington

(10) Patent No.: US 6,198,886 B1
(45) Date of Patent: Mar. 6, 2001

(54) METHOD AND APPARATUS COMPRISING PROCESS CONTROL FOR SCAVENGELESS DEVELOPMENT IN A XEROGRAPHIC PRINTER

(75) Inventor: Grace T. Brewington, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/373,281

(22) Filed: Aug. 12, 1999

(51) Int. Cl.[7] ..... G03G 15/00
(52) U.S. Cl. ..... 399/49; 399/46
(58) Field of Search ..... 399/49, 53, 55, 399/60, 72, 266, 290, 46

(56) References Cited

U.S. PATENT DOCUMENTS 5,005,050 * 4/1991 Donivan et al. ..... 399/53
5,010,367 4/1991 Hays .
5,311,258 5/1994 Brewington et al. .
5,322,970 6/1994 Behe et al. .
5,521,677 5/1996 Brewington et al. .
5,710,958 * 1/1998 Raj ..... 399/49
5,749,020 * 5/1998 Mestha et al. ..... 399/49
5,974,276 * 10/1999 Oogi ..... 399/49 X
6,035,152 * 3/2000 Craig et al. ..... 399/49

* cited by examiner

*Primary Examiner*—Sandra Brase
(74) *Attorney, Agent, or Firm*—Fay, Sharpe, Fagan, Minnich & McKee, LLP

(57) ABSTRACT

A control system for a xerographic printer utilizing hybrid scavengeless development in the marking process which selectively adjusts process parameters for closed loop feedback control to maintain a preselected tone reproduction curve. The curve is selected to enhance the effectiveness of the range of distinguishable densities in a printing device. The system monitors a series of control patches of varying area coverage density and compares the representative values from the sensor patches with preselected target values. When the measured value significantly departs from the target value, control steps are implemented to affect the toner powder cloud height in the development zone to either add or decrease the mass of toner powder deposited on the photoreceptor.

15 Claims, 6 Drawing Sheets

METHOD AND APPARATUS COMPRISING PROCESS CONTROL FOR SCAVENGELESS DEVELOPMENT IN A XEROGRAPHIC PRINTER

This invention relates to electrophotographic printing and more specifically to a process for hybrid scavengeless development wherein selectively adjustable process parameters are monitored and adjusted for closed loop feedback control of the development process to maintain a tone reproduction curve in the marking process that enhances the effectiveness and range of distinguishable densities in a printing device. More specifically, the invention relates to the control of process parameters affecting a toner powder cloud height disposed intermediate a donor roll and a photoreceptor for engendering a substantially linear response in the transfer function between the spectrum of input signals and printed output densities.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner". Toner is held on the image areas by the electrostatic charge on the photoreceptor surface. Thus, a toner image is produced in conformity with a light image of the original being reproduced. The toner image may then be transferred to a substrate or support member such as paper, and the image affixed thereto to form a permanent record of the image to be reproduced. Subsequent to development, excess toner left on the charge retentive surface is cleaned from the surface. The process is useful for light lens copying from an original document or for printing electronically generated or stored originals such as with a raster output scanner (ROS), where a charged surface may be imagewise discharged in a variety of ways.

In such electrophotographic printing, the step of conveying toner to the latent image on the photoreceptor is known as "development". The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with toner particles thereon form what is known as a magnetic brush, wherein the carrier beads form relatively long chains which resemble the fibers of a brush. This magnetic brush is typically created by means of a "developer roll". The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on the photoreceptor, the electrostatic charge on the photoreceptor will cause the toner particles to be pulled off the carrier beads and onto the photoreceptor.

An important variation to the general principle of development is the concept of "scavengeless" development. In a scavengeless development system, toner is detached from a donor roll by applying an AC electric field to self-spaced electrode structures, commonly in the form of wires positioned in the nip between a donor roll and photoreceptor. This forms a toner powder cloud adjacent thereto. Because there is no physical contact between the development apparatus and the photoreceptor, scavengeless development is useful for devices in which different types of toner are supplied onto the same photoreceptor such as in "tri-level", "recharge, expose and develop", "highlight", or "image on image" color xerography.

In hybrid scavengeless development, "hybrid" refers to the combining of concepts from single component development (applying toner to the latent image using a donor roll loaded with toner) and from two component development (applying toner to a surface from a mixture of toner and carrier).

With all development systems it is desirable to identify a control parameter for closed loop feedback control of area development. The height of the toner powder cloud is one such characteristic parameter which can be affected by a variety of related process parameters such as electrode wire AC and its amplitude, electrode wire AC frequency, electrode wire DC offset relative to the donor roll, the donor roll AC bias relative to the photoreceptor, the toner Q/M and the donor roll photoreceptor gap. Other parameters could also affect the toner powder cloud. From an alternative perspective, these same parameters represent variables which affect the tone reproduction curve of the development process. For color applications, the form of the tone reproduction curve (TRC) is extremely important to maintain for successful printing. Although it is known that the TRC of the printing device can be corrected with image processing, the development response is ideally maintained in a reasonable range so that the printer can utilize all available input gray levels (usually 256) to output distinguishable densities for each of the half-tone dot levels. Where a TRC is configured so that all the gray levels do not generate distinguishable output densities, the printing device lacks the ability to maximize a printing spectrum of useful and available output half-tone dot levels.

With particular reference to FIGS. 1A and 1B exemplary TRCs are shown which can better illustrate these concerns. Each curve relates to a particular half-tone design. The "area coverage input (%)" relates to the input signal with respect to a number of pixels which are intended to be turned on from the cell so that at 100 percent area coverage, i.e,. all pixels are turned on, the maximum density output is shown representing a fully printed solid patch. In the exemplary Figures, the "density output" range from 0 to 1.5 is a function of the measurement instrumentation used in generating these curves. Assuming that 0 percent area coverage is defined as input signal number 255 and 100 percent area coverage is defined by a signal number 0, it can be appreciated that 256 different input signals are possible. An optimal system would provide 256 visually equally spaced and distinguishable density outputs. In pictorial printing, and in particular, color pictorial printing, visually distinguishable density outputs for each possible input signal level are highly desired for higher quality printing.

FIG. 1B shows the TRC which due to its substantial nonlinearity, lacks the desired distinguishment between density outputs for the range of possible inputs. More particularly, it can be seen that nearly all of the possible range of density output is associated with only one-half of the available area coverage input range. If area coverage input percentage between 50 percent and 100 percent were associated with one-half of the available 256 input levels, i.e., only 128 of the input signals, then almost all the distinguishable density outputs are generated with merely one-half the input signals. Between 0 and 50 percent area coverage input would be associated with density outputs of between 0 and approximately 0.2. More dramatically, for only one-half of the TRC, 50 percent of the input signal levels control over 80 percent of the range of density outputs, while the other half of the input signal levels control less than 20 percent of the range of density output. For monochrome text printing, which is merely concerned with solid patch developing, this is not a particular problem, but as noted above, for color printing of pictorials it can be a substantial contouring problem and provide unacceptable print output.

With reference to FIG. 1A, the TRC is much more linear and provides a more even gradation between the full range of input and density output. The achievement and maintenance of a TRC which tends toward this linearity is the subject of this invention.

It can be appreciated that there are many parameters which can affect the TRC of a marking process. Although at initial assembly, manufacturing specifications seek to minimize drift from the design intent TRC, perceptible variations will always occur due to changing triboelectrical properties of materials over time or batch variations, changing environmental conditions such as humidity, and simple aging and wear losses that occur to any printing device.

Accordingly, there is a need for a xerographic printing device which can maintain a desirable TRC despite these continually changing operating parameters, and especially, one that can maintain a particular TRC via closed loop feedback.

BRIEF SUMMARY OF THE INVENTION

In accordance with the present invention, there is provided a process control method for maintaining a preselected TRC in a xerographic printer utilizing hybrid scavengeless development by real time adjusting a control parameter relating to clouding of toner particles in a development zone adjacent a donor roll. A characteristic representative of the toner responses to a plurality of input signals is sensed via a toner sensor to determine if the characteristic is within predetermined acceptable levels. When the characteristic is determined to be outside of acceptable levels, a control parameter affecting the toner powder cloud height between the donor roll and a photoreceptor is adjusted to return printer operation to within predetermined standards of operability.

In accordance with more limited aspects of the present invention, the control parameters are parameters affecting the preselected TRC for the development process.

In accordance with a more limited aspect of the present invention, the parameters include electrode wire AC and its amplitude, electrode wire AC frequency, electrode wire DC offset relative to the donor roll, the donor roll AC bias relative a photoreceptor adjacent thereto, toner Q/M, and gap spacing between the donor roll and the photoreceptor.

In accordance with the present invention, a xerographic printer is provided comprising a controller coupled to a sensor for sensing print quality of the printer for a plurality of varying halftone patches. The controller compares the sensed printer development to preselected target values and if the sensed value significantly varies from the target values, then any of several hybrid scavengeless development process parameters are adjusted to effect a closed loop feedback control for the development process.

It is an object and advantage of the subject invention to provide higher quality of printing for an entire spectrum of halftone cell print densities by maintaining a preselected range of TRC response through the closed loop feedback control of a plurality of process parameters for the marking process.

BRIEF DESCRIPTION OF DRAWINGS

The invention may take physical form in certain parts and steps and in an arrangement of parts and steps, the preferred embodiments of which will be described in detail in the specification and illustrated in the accompanying drawings and wherein.

DETAILED DESCRIPTION OF THE INVENTION

Figure 1A:
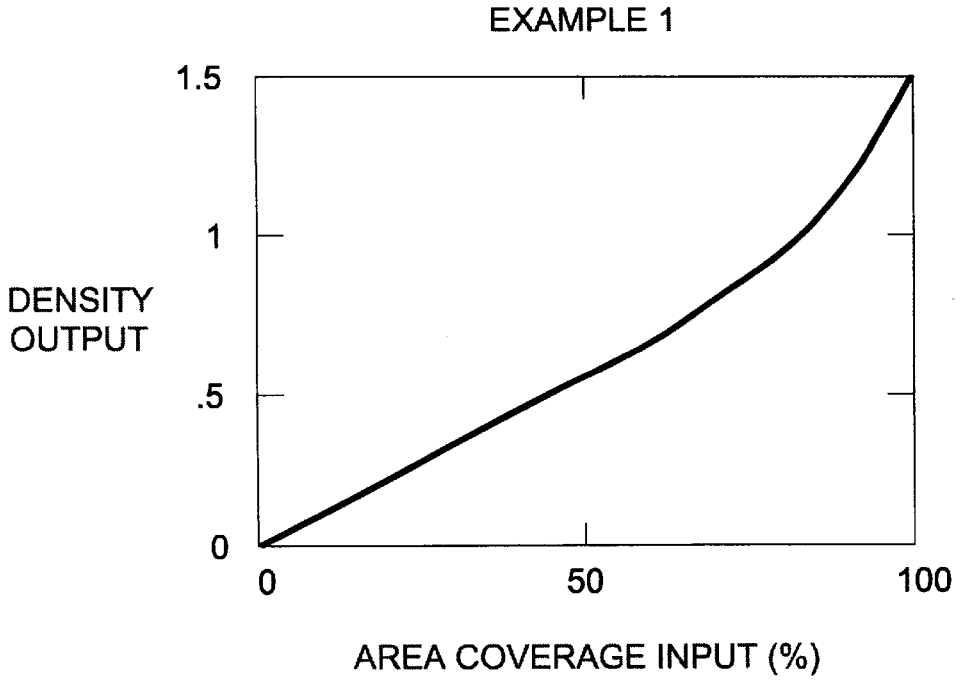
FIGS. 1A and 1B are schematic charts illustrating distinct TRCs.
Figure 1B:
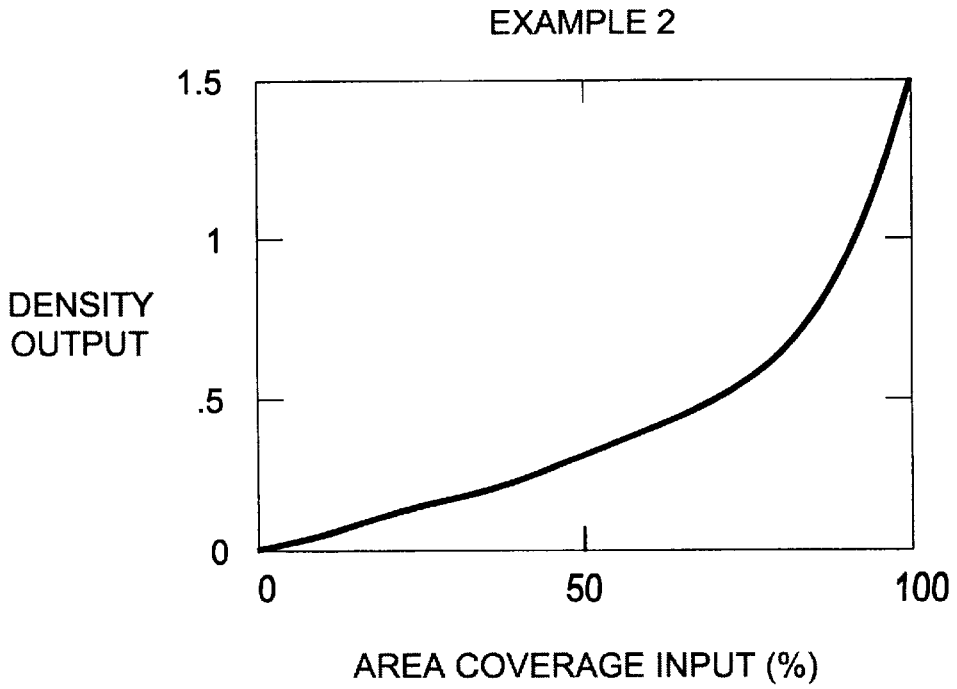
Figure 2:
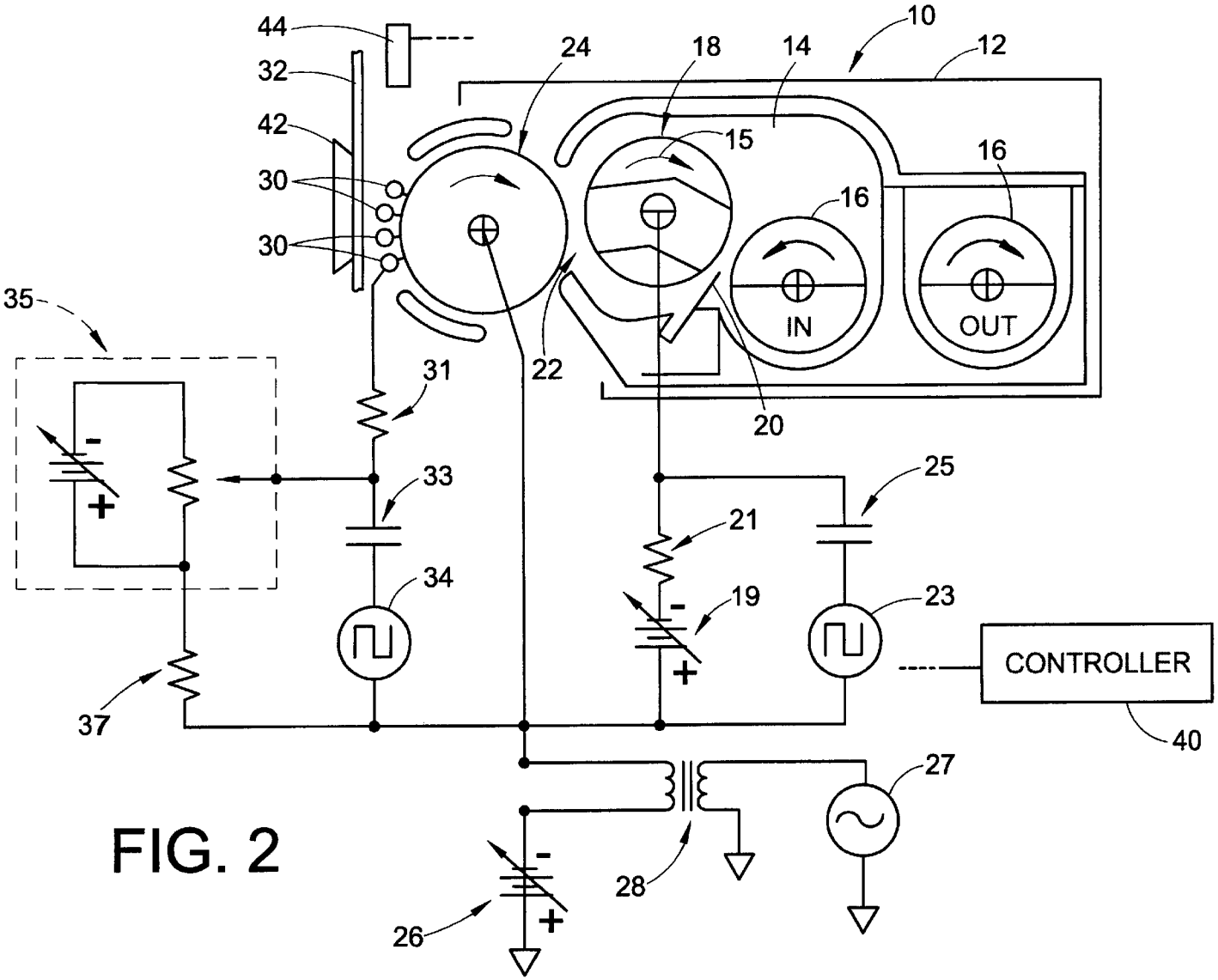
FIG. 2 is a schematic elevational view of a scavengeless development system incorporating a TRC process control system.

Referring now to the drawings wherein the showings are for purposes of illustrating the preferred embodiments of the invention only and not for purposes of limiting same, the figures show a scavengeless development system 10 (FIG. 2) including a housing 12 for storing a supply of developer material (not shown) in chamber 14. The developer includes carrier granules having toner particles adhering triboelectrically thereto. Positioned in the bottom of housing 12 are augers 16 which distribute developer material uniformly along the length of transport roll 18 rotating in the direction of arrow 15. Transport roll 18 is biased by DC voltage source 19 through current limiting resistor 21 and an AC voltage source 23, through coupling capacitor 25, is employed to control the deposit of the development material onto the transport roll 18 from the chamber 14. A trim bar 20 meters the quantity of developer material adhering to the transport roll 18 as it rotates to the loading zone comprised of the nip 22 located between transport roll 18 and donor roll 24. The donor roll 24 is kept at a specific voltage by a DC power supply 26 which applies an electrical bias on donor roll 24 so as to attract a layer of toner particles from transport roll 18 in the loading zone and to suppress the development of toner in non-image areas.

An AC voltage source 27 is connected between the DC voltage source 26 and the donor roll 24 through transformer 28 for control of line developability as is taught in U.S. Pat. No. 5,010,367 to Hays.

Electrode wires 30 are disposed and spaced between photoreceptor belt 32 and donor roll 24. Electrode wires 30 extend in a direction substantially parallel to the longitudinal axis of the donor roll 24. An AC electrical bias is applied to electrodes 30 by electrode wires power supply 34, through a coupling capacitor 33 and a current limiting resistor 31, to establish an alternating electrostatic field between electrode wires 30 and the donor roll 24. The electrostatic field causes toner to detach from the surface of donor roll 24 and form a toner cloud about electrode wires 30. The height of the cloud being such as to not contact the photoreceptor belt 32.

The DC voltage source 35 is connected in parallel with the square wave source 34 through current limiting resistor 37 to set a difference in potential between the wires 30 and the donor roll 24 for eliminating accumulation of toner build up on the wires 30. Alternatively, it is possible to provide a single AC voltage source which includes a biased waveform having a net DC component offset causing the electrode wires to be more negatively charged on average than the donor roll.

At the development zone defined in the region where belt 32 passes closest to donor roll 24, a stationary shoe 42 bears on the inner surface of belt 32. The position of this shoe 42 establishes the spacing or gap between the donor roll 24, the electrode wires 30 and belt 32. The position of the shoe 42 is adjustable.

Figure 3:
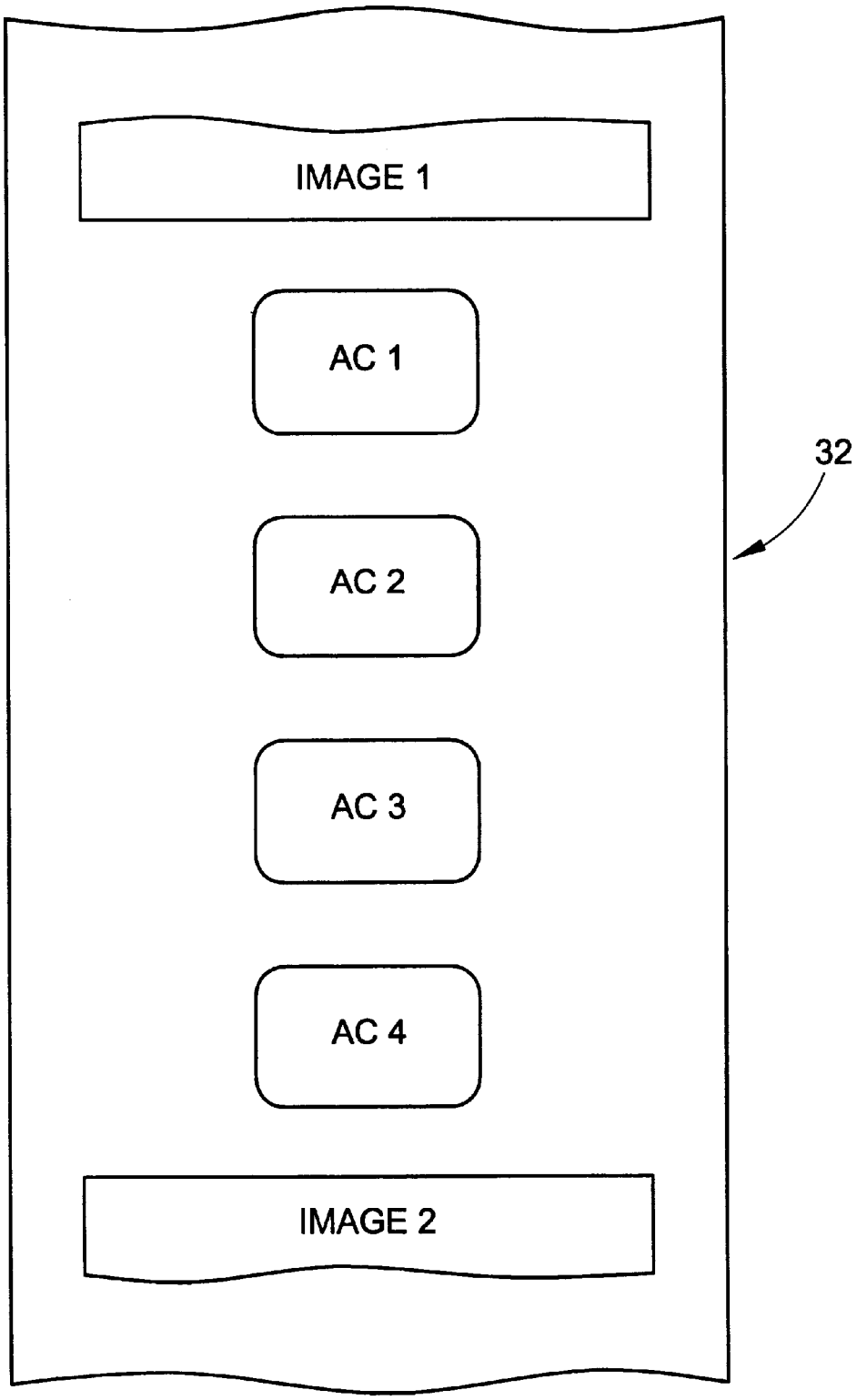
FIG. 3 shows a development patch area interposed between adjacent images recorded on the photoconductor; and, FIGS. 4A, 4B and 4C are flow diagrams of an algorithm for the operation of the subject process control system.

Sensor 44 is either a toner area coverage (TAC) sensor or an optimized color densitometer (OCD) used to detect an aspect of the development patches which is representative of the toner response of the printer. With reference to FIG. 3, it can be seen that a plurality of control patches AC1, AC2, AC3 and AC4, each having a different halftone density, e.g., 20, 40, 60 and 80 percent, area coverage as will be explained more fully below.

A TAC sensor is an infrared reflectance type sensor that measures the developed mass per unit area (DMA) of the toner patch on belt 32. The output signal from the sensor 44 is communicated to controller 40 as a feedback signal, and based upon a comparison of the output signal with predetermined targets, the controller 40 will adjust signals from the power supplies 19, 23, 26, 27, 34, 35 to the transport roll 18, the donor roll 24 and electrode wires 30. In addition, the positioning of the shoe 42 can also be adjusted for adjusting the gap between the belt 32 and the electrode wires 30, all of which adjustments are made to adjust toner cloud height and relative position to the photoreceptor belt 32.

With particular reference to FIG. 3, a plurality of toner patches, AC1, AC2, AC3, AC4, are developed in the inter-document area between image 1 and image 2 of belt 32. These toner patches are developed to have different percentage density area coverages, e.g., 20, 40, 60 and 80 percent, for testing whether the printer development is consistent with the desired TRC. Accordingly, the TAC or OCD will implement sensor readings of the control patches and the signal comprising a characteristic representative of the toner response of the printer as evidenced by the patch will be communicated by the controller 40. When a comparison with the predetermined target value is made by the controller and the result varies from the preselected target, adjustments are made in accordance with the algorithms discussed below. Although in this preferred embodiment the control patches are preferably disposed on the photoreceptor belt 32, and are thus not visible to a customer, the sensing techniques involved could also be applied to sensing readings from patches on paper also.

Figure 4A:
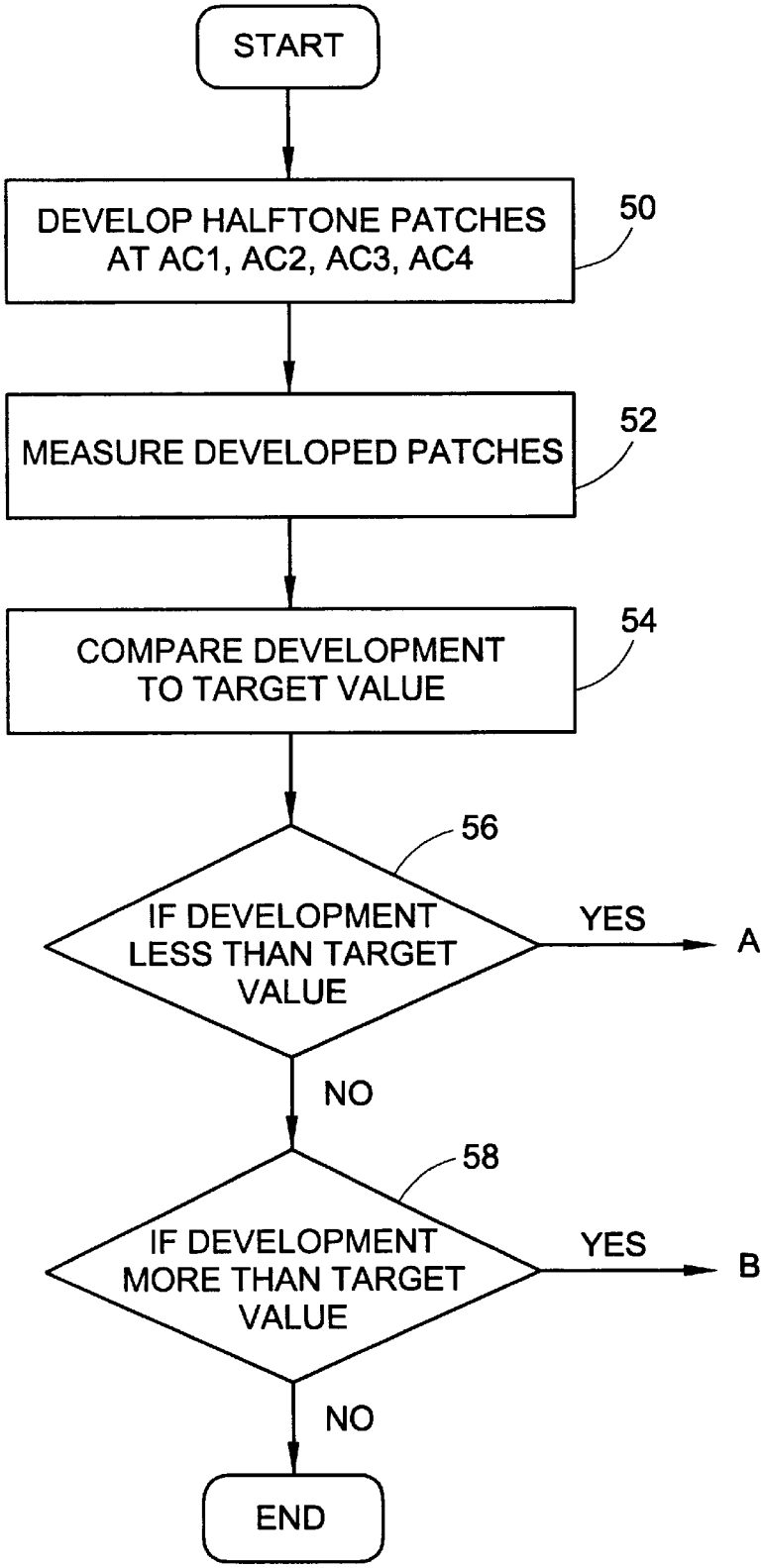
Figure 4B:
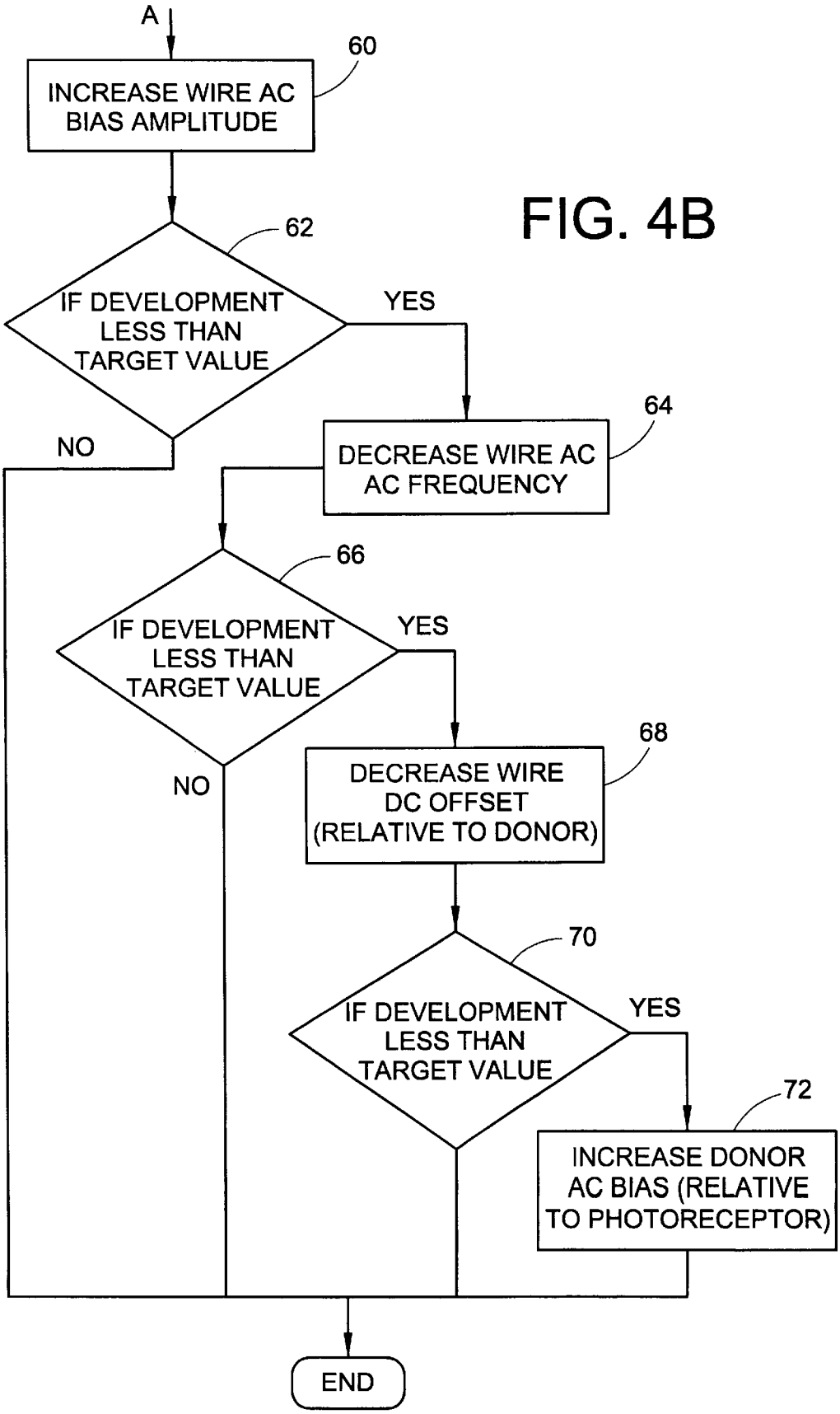
Figure 4C:
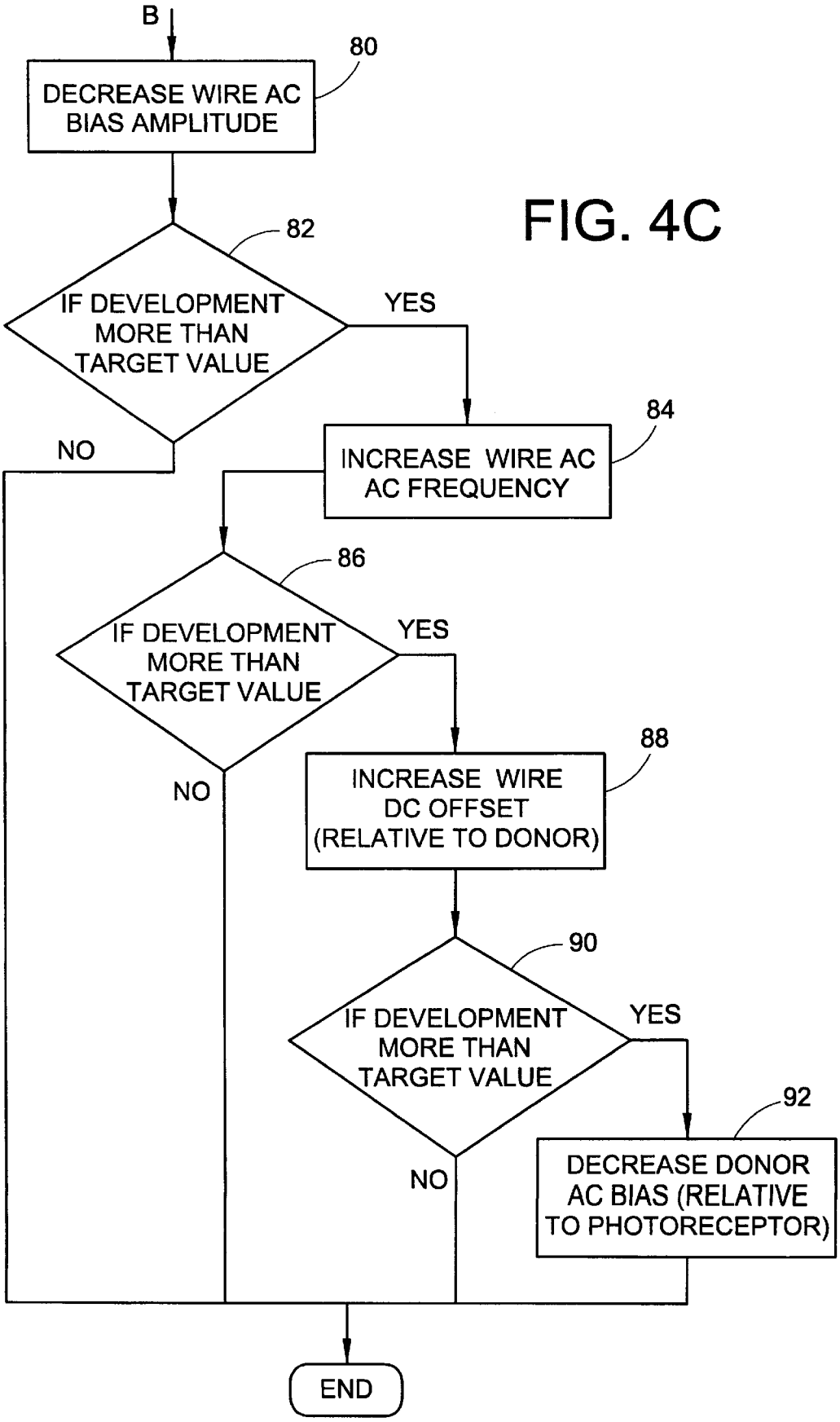

With particular reference to FIGS. 4A–4C, the steps for implementing the algorithms of this invention are discussed in more detail.

Reference to FIG. 4A, step 50 comprises developing the halftone patches as discussed above and measuring 52 the density of the developed patches. The output signal from the sensor 44 is compared 54 with the predetermined target values to determine whether the measured output density of the control patch is within the acceptable range of the target value. If the measured development is approximately equal to the target value, then no adjustments are made. If the developed value is measured as less 56 or more 58, then adjustment steps are implemented as detailed in flow charts FIGS. 4B and 4C.

With particular reference to FIG. 4B, adjustment steps are detailed that are intended to increase the developed value of the measured halftone patches. Such adjustments will affect the height of the toner cloud height relative to the belt 32 at the electrode wires and thus impart more toner on to the developed areas.

The first step to increase toner development is to increase 60 the electrode wire AC bias amplitude. The increase of the AC bias amplitude can only be up to a predetermined safe limit for arcing. If the developed mass is still too low 62, then the electrode wire AC frequency is decreased 64 down to a predetermined limit for acceptable wire strobing. If the subsequent check 66 determines that the developed value of the control patch is still less than target value 66, then the electrode wire DC offset amplitude is decreased relative to the donor roll 24 down to a predetermined limit for acceptable wire history effects from wire contamination. If the developed mass on the control patch is still too low 70, then the donor roll AC bias amplitude is increased 72 relative to the photoreceptor 32 up to the predetermined safe limit for arcing and interactivity. Adjusting some or all of these four parameters has the purpose of returning to the desired TRC range, and for nearly all purposes, the adjustment should be done in smaller steps to avoid reaching limited values of the controlled parameters. Also, the illustrated order of a parameter adjustment is not necessary in that the parameters can be adjusted in other orders.

With particular reference to FIG. 4C, the steps for adjusting the parameters of the toner cloud height when the sensed mass of the development patch is too high is illustrated. At step 80 the electrode wire AC bias amplitude can be decreased down to the predetermined limit for uniform development. If the developed mass is still too high 82, then the electrode wire AC frequency is increased 84 up to a predetermined limit set by the design of the power supply 34. If the developed mass of the toner on the photoreceptor is still too high 86, then the electrode wire DC offset amplitude relative to the donor roll 24 is increased 88 up to a predetermined limit for acceptable wire history effects from toner wire contamination, or the limit for arcing. If the developed mass is still higher than the target value 90, then the donor roll AC bias amplitude relative to the photoreceptor can be decreased 92 all way down to zero.

The adjustment algorithm can change any of the parameters identified above as well as others, e.g., the space or gap between the photoreceptor 32 and the electrode wires 30 and donor roll 24. Alternative adjustment algorithms can change the set of parameters simultaneously to increase or decrease toner mass in the development zone. Another alternative algorithm would act upon the control parameters in a different order than that presented in FIGS. 4B and 4C.

Another parameter which can adjust toner response is adjustment of the toner charge to mass ratio or Q/M. A typical cause of change in tone response in hybrid scavengeless development is a drop in the Q/M. The Q/M can be slowly increased by decreasing the toner concentration, but there is the additional constraint of staying above the toner concentration at which reload defects appear.

The subject invention provides an improved method and apparatus for concurrent adjustment of parameters for maintaining a desired TRC range that provides improved quality pictorial printing with real time adjustments to control parameters via feedback of sensing of the development process.

The invention has been described with reference to the preferred embodiment. Obviously, modifications and alterations will occur to others upon the reading and understanding of this specification. It is my intention to include all such modifications and alterations insofar as they come within the scope of the appended claims or the equivalents thereof.

Having thus described my invention, I now claim:

1. A process control method for maintaining a preselected tone reproduction curve in a xerographic printer utilizing scavengeless development by real time adjusting a control parameter relating to clouding of toner particles in a development zone adjacent a donor roll, the method comprising:

sensing a characteristic representative of tone response of the printer;

comparing the characteristic with predetermined standards comprising a substantially linear transfer function between a spectrum of input signals and a plurality of the characteristics representative of tone response; and, when the characteristic bears a predetermined relationship to the standards, adjusting the control parameter for enhancing a maximal range of distinguishable densities associated with the spectrum of input signals.

2. The method as defined in claim 1 wherein the adjusting includes adjusting the control parameter from a set of parameters affecting the preselected tone reproduction curve.

3. The method as defined in claim 2 wherein the adjusting includes parameters from the set comprising electrode wire AC bias amplitude, electrode wire AC frequency, electrode wire DC offset amplitude relative to the donor roll, donor roll AC bias amplitude relative to a photoreceptor adjacent thereto, toner Q/M and a gap spacing between the donor roll and the photoreceptor.

4. The method as defined in claim 3 wherein when the adjusting comprises increasing a developed value of the tone response, selectively adjusting the parameters for:

increasing the electrode wire AC bias amplitude;

decreasing the electrode wire AC frequency;

decreasing the electrode wire DC offset amplitude, and, increase the donor roll AC bias amplitude.

5. The method as defined in claim 3 wherein when the adjusting comprises decreasing a developed value of the tone response, selectively adjusting the parameters for:

decreasing the electrode wire AC bias amplitude;

increasing the electrode wire AC frequency;

increasing the electrode wire DC offset amplitude; and decreasing the donor roll AC bias amplitude.

6. The method as defined in claim 1 wherein the preselected tone reproduction curve is selected to maintain distinguishably spaced output densities for a selected range of input gray levels.

7. The method as defined in claim 6 wherein the comparing includes the predetermined standards representing the clouding of the toner particles for maintaining the distinguishably spaced output densities.

8. The method as defined in claim 1 wherein the adjusting comprises affecting the control parameter having a direct relationship to the clouding of toner particles in the development zone.

9. The method as defined in claim 1 wherein the sensing comprises developing a plurality of halftone patches at respectively varying percentages of area coverage.

10. A xerographic printer wherein toner particles are conveyed for printing by a scavengeless developing method including:

a donor roll for conveying the toner particles to a development zone;

an electrode disposed adjacent the donor roll for generating a toner powder cloud in the development zone;

a photoreceptor disposed adjacent the development zone and charged to record a latent image for association with the toner particles for generating a toner image;

a sensor disposed for detecting an aspect from the photoreceptor representative of the toner image; and a controller, coupled to the sensor, the donor roll and the electrode, for adjusting a control bias of the donor roll and/or the electrode and maintaining a preselected tone reproduction curve for the printer wherein the curve comprises a substantially linear transfer function between a spectrum of input signals and a plurality of the aspects representative of the toner image for enhancing a maximal range of distinguishable densities of the image toner associated with the spectrum of input signals.

11. The printer as claimed in claim 10 wherein the control bias comprises at least one from a set including electrode AC bias amplitude, electrode AC frequency, electrode DC offset relative to the donor roll, donor roll AC bias relative to a photoreceptor adjacent thereto, toner Q/M and a gap spacing between the donor roll and the photoreceptor.

12. The printer as claimed in claim 10 wherein the preselected tone reproduction curve comprises a relationship between density output and percentage of area coverage input for maintaining distinguishably spaced output densities.

13. The printer as claimed in claim 10 wherein the aspect comprises a plurality of halftone patches exhibiting a range of area coverage percentages.

14. The printer as claimed in claim 13 wherein the halftone patches are disposed on the photoreceptor.

15. The printer as claimed in claim 13 wherein the halftone patches are disposed on paper.

* * * * *